US005334354A

United States Patent [19]

Johnston et al.

[11] Patent Number: 5,334,354

[45] Date of Patent: Aug. 2, 1994

[54] LABORATORY CLAMP HAVING A FULLY ENCLOSED HINGE MECHANISM

[75] Inventors: Robert W. Johnston, Newton Square; Alan L. Hooper, Media, both of Pa.; Peter D. Byar, Willingboro, N.J.; Ronald G. Pridham, Coatesville, Pa.

[73] Assignee: Troemner, Inc., Philadelphia, Pa.

[21] Appl. No.: 944,181

[22] Filed: Sep. 11, 1992

[51] Int. Cl.[5] ..... B01L 9/00

[52] U.S. Cl. ..... 422/104; 422/99; 16/304; 16/305; 16/307; 16/374; 16/376; 24/502; 24/507; 24/510; 24/514; 248/316.5; 403/93; 403/95; 403/96

[58] Field of Search ..... 422/104, 99; 24/502, 24/507, 510, 514, 569; 248/316.5; 403/146, 145, 93, 95, 96; 16/304, 305, 307, 374, 376

[56] References Cited

U.S. PATENT DOCUMENTS

| | | | |
|---|---|---|---|
| 203,620 | 5/1878 | Henderson | 269/239 |
| 227,210 | 5/1880 | Black | 269/239 |
| 278,691 | 6/1883 | Durant et al. | 403/146 X |
| 311,487 | 2/1885 | Hall | 269/239 |
| 682,785 | 9/1901 | Caldwell | 269/157 |
| 1,515,413 | 5/1923 | Roberts et al. | 16/307 X |
| 1,895,156 | 1/1933 | Fisher | 248/316.5 |
| 2,312,638 | 3/1943 | Gedrts | 16/374 X |
| 3,779,108 | 12/1973 | Reiter | 24/510 X |
| 3,893,813 | 7/1975 | Johnson | 422/104 X |
| 4,890,950 | 1/1990 | Yoo | 403/96 |
| 5,037,231 | 8/1991 | Kitamura | 403/120 |
| 5,062,179 | 11/1991 | Huang | 16/111 |

FOREIGN PATENT DOCUMENTS 0578749 7/1946 United Kingdom .

OTHER PUBLICATIONS

Fisher Catalog (1988 Edition), p. 292, item 05-769, Castaloy Utility Clamps.

Baxter Catalog (1991 Edition), p. 642, item C6013-4, S/P ® Brand Combination Clamps.

*Primary Examiner*—James C. Housel

*Assistant Examiner*—Harold Y. Pyon

*Attorney, Agent, or Firm*—Dann, Dorfman, Herrell and Skillman

[57] ABSTRACT

Utility clamp for use in a laboratory or other environment containing caustic elements. The clamp has a fully-enclosed hinge which is isolated from the environment. The critical hinge components such as the hinge pin and coil spring are internally located in the hinge and are protected from corrosion or attack by agents which might contact the clamp during normal use. A method is also provided for assembling the clamp whereby pre-loaded springs are positioned within the internal cavity to normally bias the jaws of the clamp in an open position relative to each other.

15 Claims, 4 Drawing Sheets

LABORATORY CLAMP HAVING A FULLY ENCLOSED HINGE MECHANISM

FIELD OF THE INVENTION

The present invention relates to a utility clamp especially well suited for use in a laboratory or other environments containing caustic agents. The present clamp has a fully enclosed hinge to protect the hinge pin and internal torsional spring from corrosion and contamination.

BACKGROUND OF THE INVENTION

The utility clamp currently used in most scientific laboratories was patented in 1933 by E. H. Fisher, U.S. Pat. No. 1,895,156. The Fisher clamp comprises a pair of opposed jaws pivotally connected at one end to an arm, an external spring disposed between the jaws to urge them apart, and adjustment means, such as a pair of thumb screws, for selectively positioning the jaws relative to each other. The spring is a torsion spring coiled around the outside of the hinge pin. This basic design has proved very useful for most laboratory applications over the years and has changed very little since 1933.

A laboratory utility clamp, such as the clamp disclosed by Fisher, is likely to contact deleterious agents such as acids and other caustic solvents which corrode and contaminate the clamp's critical elements such as the hinge pin and coil spring. While the arms and bracket of the Fisher clamp enshroud the sides of the spring and hinge, the spring and hinge are exposed on the face proximal to the workpiece positioned in between the jaws. During normal use of the clamp, contaminants contact and corrode the spring and hinge pin causing the hinge to seize and/or the spring to prematurely fail, or otherwise adversely affect the performance of the clamp.

Additionally, the bracket or yoke which houses the hinge pin on the Fisher clamp and other prior art utility clamps projects outwardly toward the workpiece and occupies the throat i.e. the empty space in between the jaws. Since the bracket reduces the size of the throat, the clamping capacity of the clamp is limited on complicated structures.

SUMMARY OF THE PRESENT INVENTION

The present invention provides a utility clamp well suited for use in a laboratory or other environment containing caustic agents. The present clamp has a hinge mechanism with a fully-enclosed hinge pin and torsion bias mechanism which normally biases the jaws into an open position. Since the hinge is fully enclosed, the critical hinge components such as the hinge pin and internal torsional spring are protected by corrosion and contamination from the elements encountered in such environments.

The hinge comprises a stacked series of discs having an internal cavity within which the critical internal components of the hinge are located. The outer discs are formed on the ends of the jaws and comprise part of the hinge mechanism. The central disc is connected to an extension arm on the clamp and is connected with the outer discs by a hinge pin. The present invention may have either one or two rotatable/adjustable jaws and corresponding torsion spring(s).

The hinge mechanism of the present invention also provides an enlarged throat to accomodate larger workpieces and more complicated structures than prior art clamps. The hinge on the present utility clamp does not have a bracket or yoke which projects into and which reduces the size of the throat.

The present invention also provides a method of assembling the present clamp wherein the torsion spring(s) is pre-loaded within the internal cavity before the cavity is sealed so that the adjustable jaw(s) of the clamp is normally biased into an open position relative to the other jaw. The spring(s) is held in a pre-loaded position by a temporary stop which is inserted through a small bore into the cavity and which does not interfere with the assembly of the discs or other components of the hinge mechanism. Once the hinge is fully assembled, the temporary stop is removed and the small bore is plugged to seal the internal cavity from the environment.

DETAILED DESCRIPTION OF A PREFERRED EMBODIMENT

Figure 1:
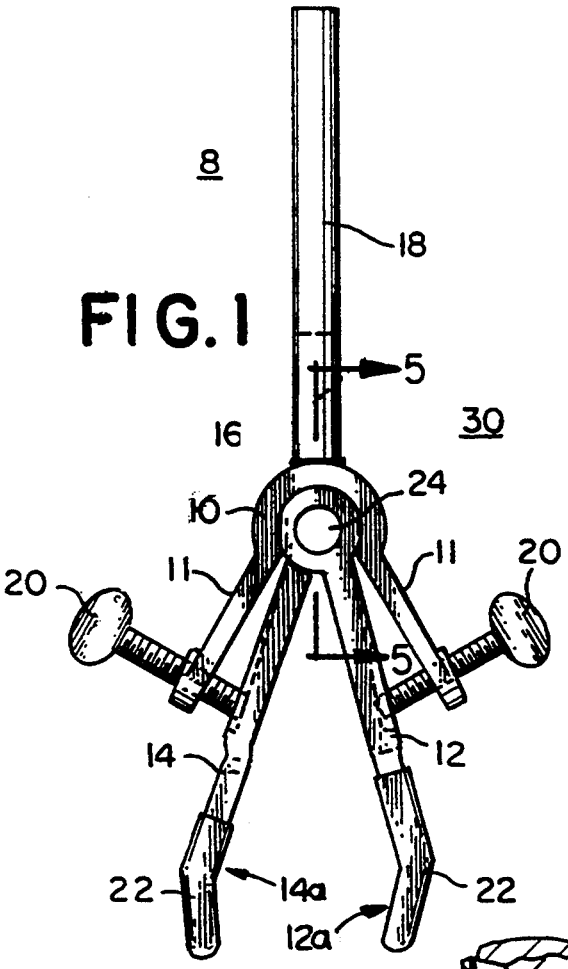
FIG. 1 is a front, plan view of one embodiment of the utility clamp of the present invention having two adjustable jaws.
Figure 2:
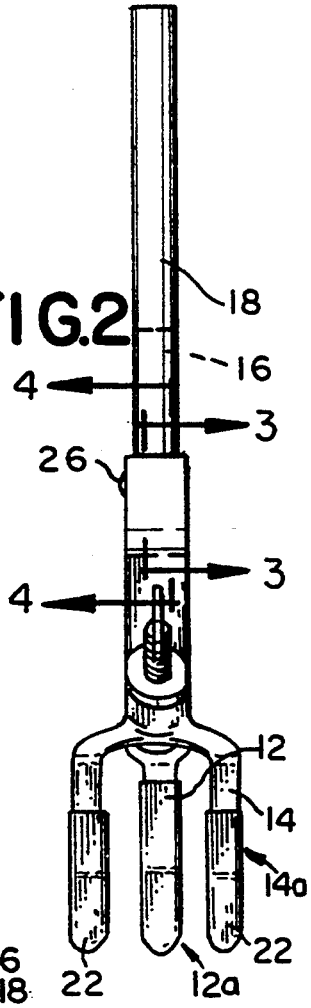
FIG. 2 is a side, elevational view of the utility clamp of FIG. 1.

The present invention may have either a single or pair of movable jaws for grasping a workpiece. A first embodiment of the present invention is illustrated in FIGS. 1 and 2, generally designated by the reference numeral 8, and has two movable jaws for clenching an object such as a beaker or test tube. A second embodiment of the present invention is illustrated in FIGS. 7–11, generally designated by the reference numeral 108, and has one movable jaw and one stationary jaw. In each embodiment the movable jaw(s) is pivotally mounted on a hinge, generally designated by the reference numeral 30 and 130, respectively, and has spring means which normally urges the jaw(s) into an open position relative to the other jaw. In both embodiments, the movable hinge operates in the same manner. In the embodiment having two movable jaws, the hinge is bifurcated each side operating in substantially the same way as the other side but on the opposed jaw.

Referring to FIGS. 1 and 2, a first embodiment of the present invention has a base bracket 10 and an arm 16 extending from the bracket 10. The extension arm 16 is adapted to receive an extension tube 18 which is supported by a laboratory stand (not shown). The clamp 8 has a pair of movable jaws 12 and 14 each of which is attached to a hinge, generally designated by the reference numeral 30, which is fixed to the base bracket 10. As best seen in FIG. 2, one jaw 14 has two fingers 14*a* and the other jaw 12 has a single finger 12*a* formed at the end of each jaw. The fingers 12*a* and 14*a* are preferably covered with latex finger covers 22 to increase the coefficient of friction of the fingers for better gripping. If the fingers are to be exposed to a high temperature heat source or other conditions detrimental to the latex covers, the latex finger covers 22 may be removed and replaced with fiberglass finger covers to protect the fingers from the high temperature heat source or other conditions.

The hinge 30 normally biases the jaws in an open position as seen in FIG. 1. Each jaw rotates independently of the other jaw. To adjust the position of each jaw and lock the jaws on the workpiece, the clamp 8 has adjustment screws 20 located on the legs 11 of the base bracket 10. The adjustment screws, or thumbscrews, fit in threaded bores located in the legs 11 and tighten against the jaws upon rotation of the screws.

Figure 5:
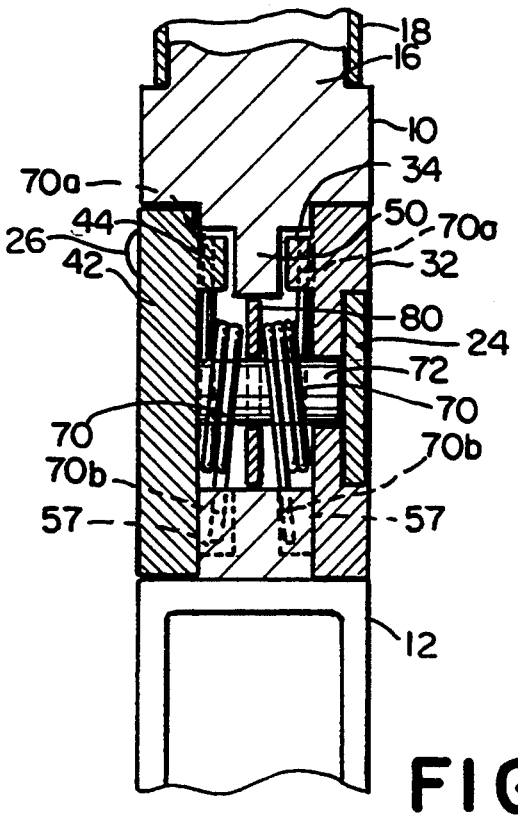
FIG. 5 is an enlarged, sectional view taken along the section line 5—5 of FIG. 1 showing the internal components of the hinge mechanism.
Figure 6:
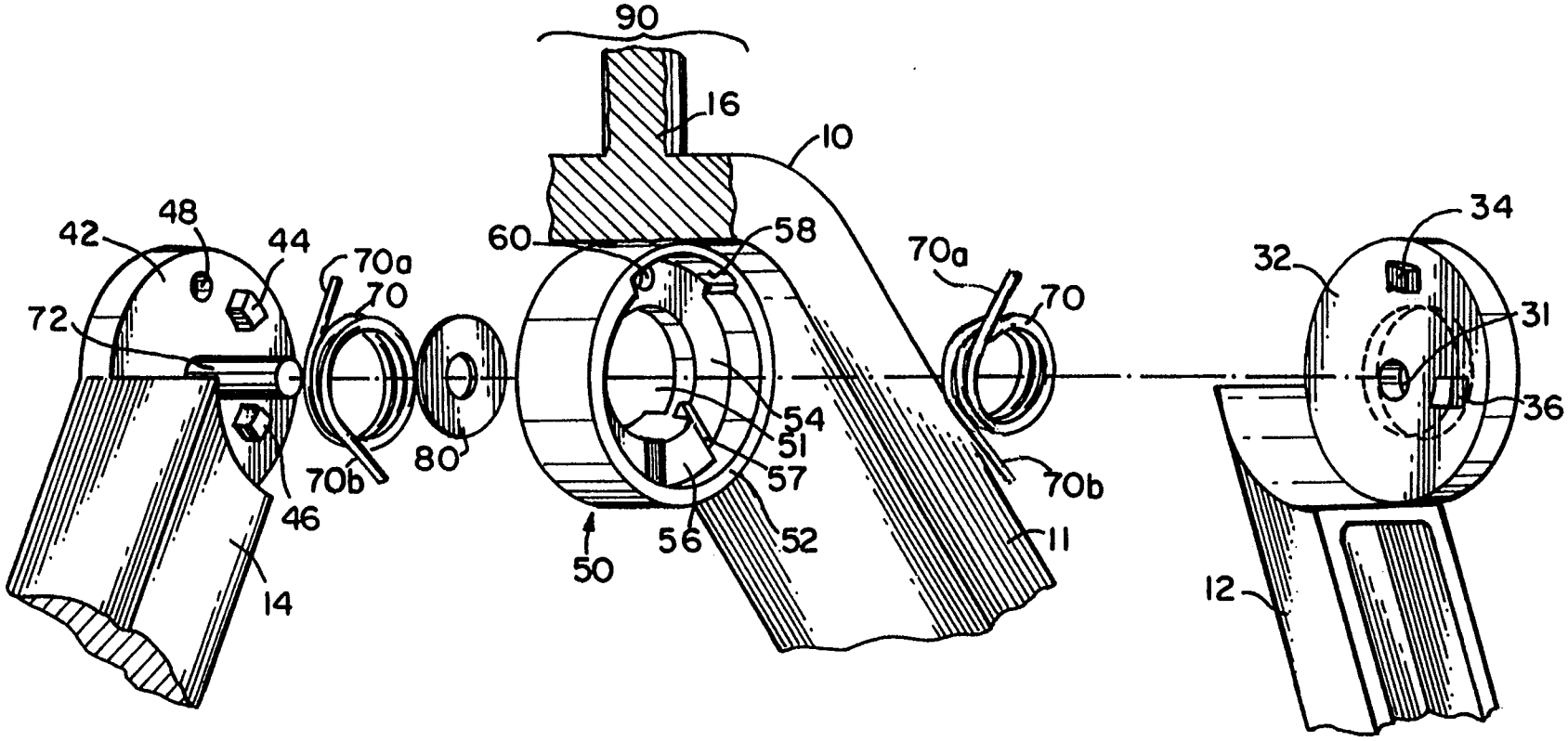
FIG. 6 is an exploded, perspective view of the hinge mechanism illustrated in FIG. 1.
Figure 7:
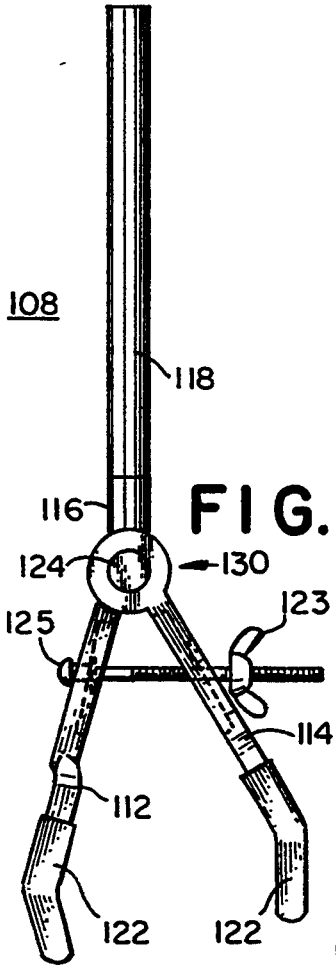
FIGS. 7 and 8 are opposed, front-plan views of another embodiment of the present utility clamp having a one adjustable jaw and one fixed jaw.
Figure 8:
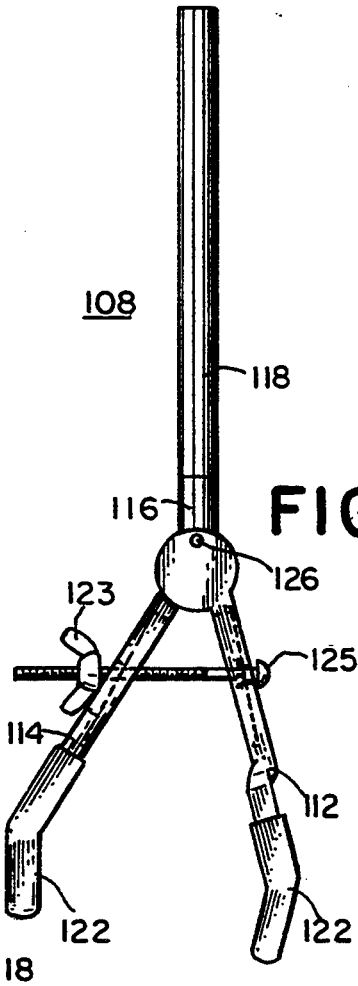
Figure 9:
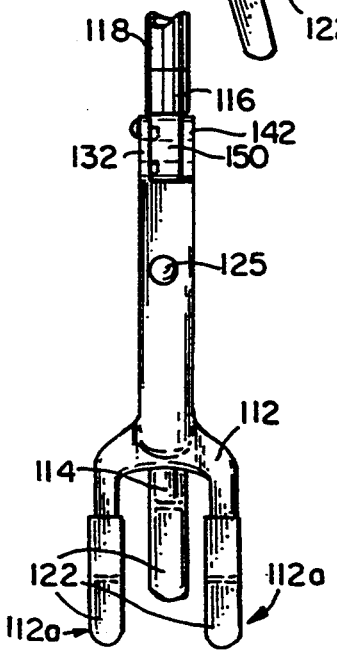
FIGS. 9 and 10 are opposed, side-elevational views of the clamp illustrated in FIGS. 7 and 8; and, FIG. 11 is an exploded, perspective view of the internal construction of the portion of the hinge mechanism illustrated in FIGS. 7–10 which connects to the fixed jaw.
Figure 10:
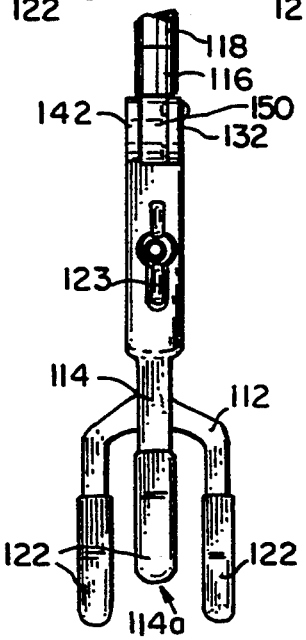

As best seen in FIG. 5, the hinge 30 is bifurcated, each side constructed and arranged essentially in the same manner as the other side. The hinge has a central disc 50 fixed to the base bracket 10 in between the bracket legs 11. Referring to FIG. 6 and describing one side of the central disc, the central disc 50 has a center bore 51, and an annular rim 52 at the edge of the disc which defines a cavity 54 on the side of the disc. A stop 56 and a recess 57 are located on the central disc 50 within the cavity 54. The annular rim 52 also has a recess 58 along a small arc of the rim which is offset about 150 degrees from the disc recess 57. The central disc has a small, axial bore 60 in the central disc 50 along the arc defined by the recess 58 in the annular rim 52. Both sides of the central disc are identical.

Figure 3:
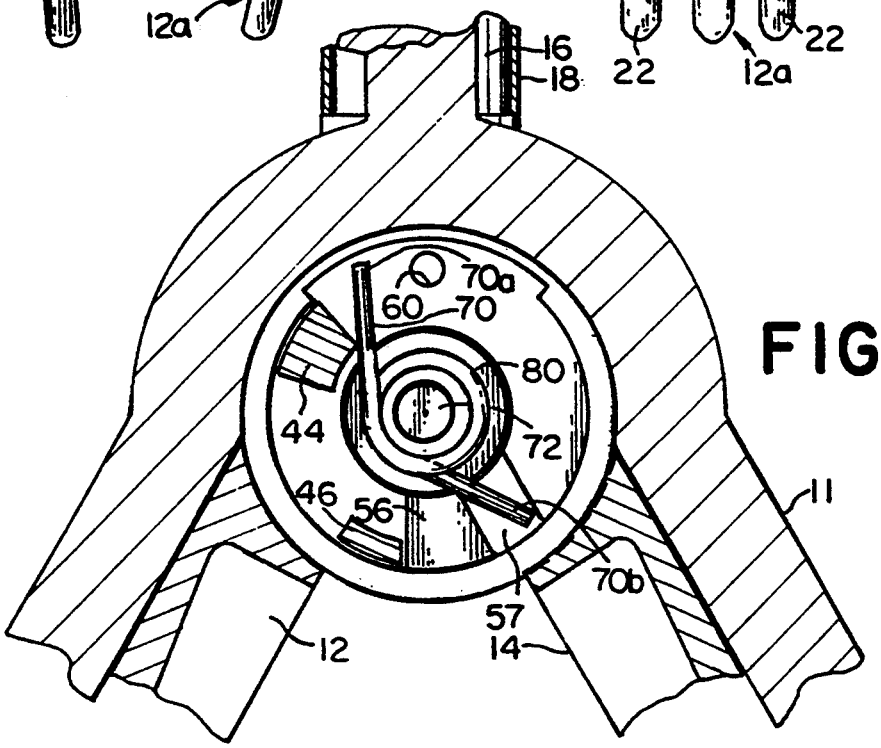
FIG. 3 is an enlarged, sectional view taken along the section line 3—3 of FIG. 2 showing the hinge mechanism in the fully-open position.
Figure 4:
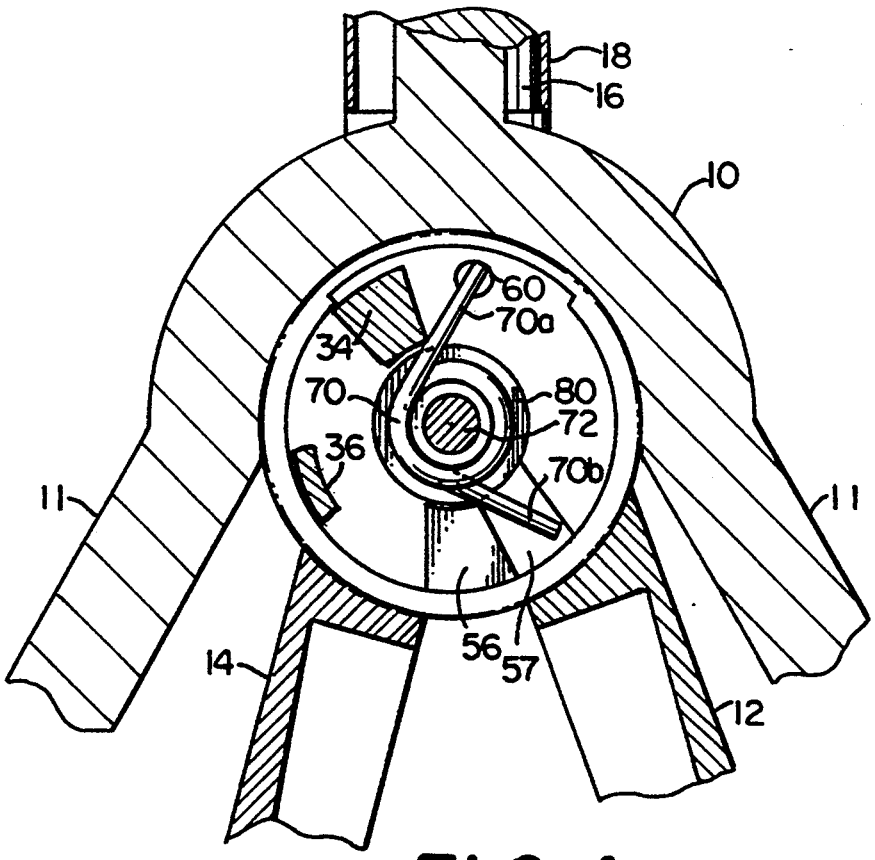
FIG. 4 is an enlarged, sectional view taken along the section line 4—4 of FIG. 2 showing the hinge mechanism after partial rotation of the jaws.

Surrounding and enclosing both sides of the central disc are outer discs 32 and 42 which are attached or formed at the end of the jaws 12 and 14, respectively. The outer discs 32 and 42 have about the same diameter as the central disc 50 and fully enclose the cavity 54 on both sides of the disc 50. Each outer disc 32 and 42 has a pair of bosses 34,36 and 44,46, respectively, which extend generally normal to the disc surface. One boss 36 or 46 on each disc 32 or 42, respectively, defines the one rotational, limit position by contacting the stop 56 on the central disc 50 as seen for example in FIG. 3. When the hinge is assembled the bosses travel within the cavity 54 and within the annular rim 52. As seen in FIG. 4 each jaw is free to rotate until it is impeded by the other jaw 14 thereby defining the other rotational limit position. The bosses 34,36 and 44,46 rotate along an unobstructed path within the cavity of the central disc 50.

Both discs are substantially similar except that the first disc 42 has a hinge pin 72 fixed generally normal to the disc surface. The hinge pin connects the two outer discs through the center bore 51 in the central disc 50. The hinge pin is inserted through a center bore 31 in the second outer disc 32 and attached thereto by spin riveting. The diameter of the bore 31 in the second disc is slightly larger than the diameter of the hinge pin 72. Additionally the first disc 42 has a small, axial bore 48 through the thickness of the disc 42 similar to the small axial bore 60 through the thickness of the central disc 50. Both small bores 48 and 60 are used during the assembly process, described hereinafter, after which the bore 48 in the first outer disc 42 is plugged or sealed with, for example, a drive pin 26. Further, the second disc 32 has a bored recess on the outer surface around the central bore 31 as best seen in FIG. 5. The recess provides a recessed location for spin riveting the end of the hinge pin 72 to affix the second disc 32 to the hinge pin. A rivet cap 24 is placed in the recess after assembly to provide a flush surface and to seal the outer surface of the second disc 12 and protect the end of the hinge pin from corrosion.

A torsion spring 70 is located within each cavity as best seen in FIG. 5, and coiled around the hinge pin 72. One end 70*b* of the spring is inserted into and is held by the recess 57 while the other end 70*a* contacts and is held by the second boss 34 and 44 on each outer disc, 32 and 42, respectively. A washer 80 is positioned on the hinge pin 72 in between the two springs 70 as best seen in FIGS. 5 and 6. The torsion springs 70 exert a resistive force on the outer discs which normally orients the jaws in an open position as illustrated in FIG. 3.

Referring to FIG. 5, the hinge pin 72 and the torsion springs 70 are each fully enclosed within the internal cavities of the hinge and are protected from any deleterious or caustic agents which may contact the clamp. The outer discs 32 and 42 are closely fitted with the central disc to provide a substantially isolated internal chamber. The rivet cap 24 and the drive pin 26 also seal the outer surface of the hinge to prevent contamination or corrosion of the internal components.

As best seen in FIG. 1 the throat of the present clamp is completely unobstructed by the bracket 11 as compared with prior art clamps. Consequently, the throat of the present clamp is larger than prior art clamps and can accomodate larger and more complex workpieces in the area in between the jaws. Other apparatus can be placed deep into the throat relative to the clenched workpiece without interfering with the clamp.

The present invention also provides a unique method of assembling the aforementioned clamp. The present method of assembly provides a quick and practical way of performing the difficult task of assembling a preloaded spring in a fully-enclosed cavity. Referring to FIG. 6, the base bracket assembly or yoke, designated generally as numeral 90, comprising the base bracket 10, legs 11, extension arm 16 and central disc 50, is clamped face down in a work station. A temporary, spring loaded hinge pin is inserted upwardly through the center bore 51. A torsion spring 70 is applied over the temporary hinge pin, placing one end 70*b* in the recess 57. The spring is next pre-loaded by rotating the other end 70*a* of the spring clockwise past the small, axial bore 60, at which time a temporary stop is upwardly inserted through the bore 60. The tool used to pre-load the spring is removed allowing the other end 70*a* of the spring to rotate counterclockwise until it impinges on the temporary stop.

Next, the first outer disc/jaw is placed on the central disc. The outer disc 42 having the affixed hinge pin 72 is placed on the central disc first. As the outer disc 42 is placed on the central disc, the hinge pin 72 pushes down on the temporary, spring-loaded hinge pin, thereby replacing the temporary hinge pin in the assembly while not disturbing the pre-loaded spring. The outer disc 42 is initially position such that one boss 44 is placed on the same side of the other end 70*a* of the spring as the temporary stop. The temporary stop is then removed allowing the other end 70*a* of the spring to impinge the boss 44, thereby rotationally urging the outer disc 42 counterclockwise. In this manner the spring has been preloaded, thereby normally biasing the jaw 14 in an open position, and the cavity on the one side of the disc has been enclosed.

The other side of the central disc 50 is assembled in substantially the same way as the first side by inverting the partially assembled clamp in the work station. Since the permanent hinge pin 72 is now in place, the temporary hinge pin is not required to assemble the second side of the central disc. A washer is first placed over the hinge pin 72 to separate the two springs. The second torsion spring 70 is placed over the hinge pin 72 with one end 70*b* in the recess 57. The second spring is next preloaded by rotating the other end 70*a* of the spring clockwise past the small, axial bore 60, at which time a temporary stop is upwardly inserted through the bore 48 in the first outer disc 42 and through the bore 60 in the central disc. The tool used to pre-load the spring is then removed allowing the other end 70*a* of the spring to rotate counterclockwise until it contacts and is held by the temporary stop.

Next, the second outer disc/jaw is placed on the central disc. Like the first outer disc 42, the second outer disc 32 is initially position such that one boss 34 is placed on the same side as the temporary stop relative to the other end 70*a* of the spring. The temporary stop is then removed allowing the other end 70*a* of the spring to impinge the boss 34, thereby rotationally urging the outer disc 32 counterclockwise. The end of the hinge pin protruding through the center bore 31 in the disc 32 is spin rivetted to hold the second disc 32 on the hinge pin 72 and hold the hinge assembly together. A rivet cap 24 is then placed in the recess around the central bore 31 to seal the outer surface of the second disc and protect the hinge from corrosion. The small axial bore 48 in the first outer disc 42 is also plugged or sealed with, for example, a drive pin 26 to seal the internal cavity.

A second embodiment of the present invention is illustrated in FIGS. 7–11 and comprises a clamp 108 having one adjustable jaw 114 and one fixed jaw 112. Each jaw is attached to a hinge, generally designated by the reference numeral 130, which is fixed directly to an extension arm 116 adapted to receive an extension tube 118 which is supported by a laboratory stand (not shown). The fixed jaw 112 has two fingers 112*a* and the adjustable jaw 114 has a single finger 114*a* formed at the end. Each finger is preferably covered with latex or fiberglass finger covers similar to the first embodiment.

As seen in FIGS. 7–10, the hinge normally biases the adjustable jaw 114 in an open position relative to the fixed jaw 112. A carriage bolt 125 traverses and connects the two jaws and is provided with a wing nut 123 to adjust the position of the jaws and lock the jaws on the workpiece. An "E" ring is applied to the shank of the bolt near the head on the side of the jaw opposite the head to hold the bolt on the jaw should the wing nut be removed.

Figure 11:
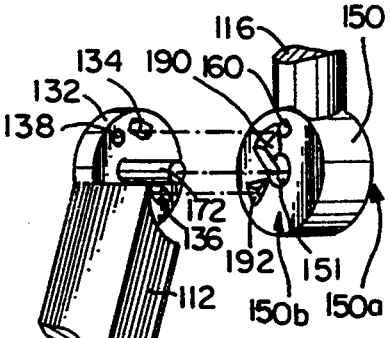

Referring to FIG. 11, the hinge has a central disc 150 fixed directly to the extension arm 116. Unlike the central disc in the first embodiment, the central disc 150 has a different configuration on opposed sides. One side of the disc 150*a* is constructed and arranged identical to the sides of the disc 50 of the first embodiment to accommodate an adjustable jaw having a disc constructed and arranged similarly to the second disc 32 in the first embodiment. The other side 150*b* of the central disc is constructed and arranged to accommodate the fixed jaw 112 and has a center bore 151 and two separate recesses 190 and 192 in the surface. The disc 150 also has an axial bore through the thickness of the disc to accommodate a retractable, temporary stop used during assembly of the hinge.

The other side 150*b* of the disc mates with an outer disc 132 which is fixed or formed at the end of the fixed jaw 112. The outer disc 132 has two bosses 134 and 136 which closely fit into the two recesses 190 and 192 on central disc, respectively, when the two discs are adjacently engaged. The outer disc 132 has a hinge pin 172 fixed generally normal to the disc surface. The hinge pin 172 connects the two outer discs in the same manner as in the first embodiment.

Unlike the first embodiment, the one side 150*b* of the central disc 150 does not have a cavity within which the two bosses 134 and 136 may freely travel. Rather the bosses 134 and 136 closely fit into the recesses 190 and 192 to hold the outer disc 132 fixed relative to the central disc 150, and thus hold the one jaw 112 fixed.

The second embodiment of the present invention is assembled in a manner similar to the first embodiment. The central disc is first mated with the fixed disc 132 and held face down in a work station. In this configuration the hinge pin 172 protrudes upwardly through the center bore 151 to the other side 150*a* of the disc 150. The other side 150*a* of the hinge is next assembled in the same manner as in the first embodiment. The torsion spring is placed over the hinge pin and preloaded. A temporary stop is upwardly inserted from the opposite side 150*b* through the small axial bore 138 in the outer disc 132 and through the axial bore 160 in the central disc 150. The spring is then unloaded and allowed to impinge the temporary stop. The second outer disc is placed on the hinge pin in a position such that one of the bosses 134 of the second disc 142 is one the same side of the temporary stop relative to the spring. The temporary stop is then removed allowing the spring to impinge the boss 134, thereby rotationally urging the second disc 132 and jaw 114 counterclockwise into an open position. The free end of the hinge pin protruding through the center bore in the outer disc 142 is spin rivetted to hold the disc 142 on the hinge pin 172 and hold the hinge assembly together. A rivet cap 124 is then placed in the recess around the bore to seal the outer surface of the second disc and protect the end of the hinge pin from corrosion. The small axial bore 138 in the outer disc 132 is also plugged or sealed with a drive pin to seal the internal cavity.

The present invention is not limited to the particular embodiments herein illustrated and described, but changes and modifications may be made therein and thereto within the scope of the following claims.

We claim:

1. A utility clamp resistant to corrosion of internal components when exposed to caustic environments, comprising a pair of opposed jaw members mounted for relative pivotal movement about a hinge axis between open and closed positions;

an extension arm adapted to support said jaw members;

a fully-enclosed hinge on said extension arm, said hinge having a central disc portion with a central passage therethrough providing a cavity, a hinge pin defining said hinge axis, and pre-loaded torsion bias mechanism internal of said cavity so as to be isolated from the environment, said pre-loaded torsion bias mechanism continuously urging at least one of said jaw members in one direction between the open and closed positions;

said pair of opposed jaws each having an outer disc portion comprising part of said hinge, the outer disc portions of said pair being on opposite sides of said central disc portion and covering said central passage to provide a closed cavity defined by said passage between said outer disc portions, said jaws normally biased to an open position by said pre-loaded torsion bias mechanism; and an adjustment mechanism for adjusting and locking said jaws in a closed position relative to each other against the urging of said pre-loaded torsion bias mechanism.

2. A utility clamp as recited in claim 1 wherein each of said pair of jaws is mounted for pivotal movement relative to said extension arm, said clamp including a bifurcated bracket mounted on said extension arm and having opposed legs straddling said hinge and said pair of jaws, said adjustment mechanism including a clamp element mounted in each leg and operatively engaging an adjacent jaw to displace said jaw against the bias of said torsion bias mechanism.

3. A utility clamp according to claim 2 each of said pair of jaws being mounted for pivotal movement relative to said central disc portion, said torsion bias mechanism comprising a pair of springs, each spring being pre-loaded between one of said jaws and said central disc portion within said hinge cavity.

4. The utility clamp as recited in claim 3 wherein said central disc has a center bore and a cavity on each side of said central disc, said disc portions of said jaws pivotally connected through said center bore by said hinge pin, said torsion bias mechanism comprising a separate spring element located within each of said cavities to rotationally urge said outer discs about said central disc.

5. The utility clamp as recited in claim 4 wherein each side of said central disc has an annular rim defining said cavity, a stop and a recess within said cavity, and said outer discs have a pair of bosses which are freely movable within said cavity.

6. The utility clamp as recited in claim 5 wherein each spring element comprises a coil spring wound around said hinge pin, said spring having opposed ends, said one end being seated in said recess and the other end contacting one of said bosses.

7. The utility clamp as recited in claim 2 wherein said adjustment mechanism comprises a thumb screw located on each of said legs.

8. A utility clamp as recited in claim 1 wherein said arm includes said central disc portion, one of said jaws being mounted for pivotal movement relative to said central disc portion, the other of said jaws being fixed relative to said central disc portion, said torsion bias mechanism comprising a spring, said spring being pre-loaded between said disc portion of said movable jaw and said central disc within said hinge cavity.

9. A utility clamp according to claim 8 wherein said adjustment mechanism includes a clamp element mounted in each leg and operatively engaging an adjacent jaw to displace said movable jaw against the bias of said spring.

10. The utility clamp as recited in claim 8 wherein said central disc has a center bore and a cavity on one side of said central disc, said disc portion of said movable jaw pivotally connected to said central disc by said hinge pin, said torsion bias mechanism being located within said central disc cavity.

11. The utility clamp as recited in claim 10 wherein said central disc has an annular rim defining said cavity, a stop and a recess within said cavity, and said outer disc on said movable jaw has a pair of bosses which are freely movable within said cavity.

12. The utility clamp as recited in claim 11 wherein said torsion bias mechanism comprises a coil spring wound around said hinge pin, said spring having opposed ends, said one end being seated in said recess and the other end contacting one of said bosses.

13. The utility clamp as recited in claim 1 for use with a temporary stop member adapted to be inserted into and displaced from the cavity of said hinge, wherein at least one of said disc portions has a circumferential rim surrounding and defining said cavity, a boss projecting into said cavity at a first position adjacent said rim to provide a seat for one end of said torsion bias mechanism, and an access bore extending through said one disc portion into said closed cavity and providing entry into said cavity of the temporary member at a second position capable of serving as a temporary seat for the opposite end of said torsion bias mechanism during assembly of the clamp and enabling displacement of said temporary stop member after assembly of the clamp.

14. The utility clamp as recited in claim 13 including a plug fitted into said access bore after displacement of said temporary stop member away from the second position, said plug closing said cavity to infusion of caustic components from the environment into said cavity.

15. A utility clamp resistant to corrosion of internal components when exposed to caustic environments, comprising a pair of opposed jaw members mounted for relative pivotal movement about a hinge axis between open and closed positions;

an extension arm adapted to support said jaw members;

a fully-enclosed hinge on said extension arm, said hinge having a central disc portion with a central passage therethrough providing a cavity, a hinge pin defining said hinge axis, and pre-loaded torsion bias mechanism internal of said cavity so as to be substantially isolated from the environment, said pre-loaded torsion bias mechanism continuously urging at least one of said jaw members in one direction between the open and closed positions;

said pair of opposed jaws each having an outer disc portion comprising part of said hinge, the outer disc portions of said pair being on opposite sides of said central disc portion and covering said central passage to provide a closed cavity defined by said passage between said outer disc portions, said jaws normally biased to an open position by said pre-loaded torsion bias mechanism;

an access bore extending through said hinge into said closed cavity, constructed and arranged to receive a temporary stop operable during assembly of the clamp to engage and pre-load said torsion bias mechanism; and an adjustment mechanism for adjusting and locking said jaws in a closed position relative to each other against the urging of said pre-loaded torsion bias mechanism.

* * * * *